United States Patent [19]

Sato

[11] Patent Number: 4,639,702

[45] Date of Patent: Jan. 27, 1987

[54] REED RELAY

[75] Inventor: Ryuichi Sato, Kyoto, Japan

[73] Assignee: Omron Tateisi Electronics Co., Kyoto, Japan

[21] Appl. No.: 785,825

[22] Filed: Oct. 9, 1985

[30] Foreign Application Priority Data

Oct. 9, 1984 [JP] Japan ..... 59-152920[U]

[51] Int. Cl.[4] ..... H01H 1/66; H01H 51/00

[52] U.S. Cl. ..... 335/153; 335/81; 335/179; 335/229

[58] Field of Search ..... 335/78, 79, 81, 83, 335/91, 93, 94, 179, 229, 202, 153, 154

[56] References Cited

U.S. PATENT DOCUMENTS 4,182,998 1/1980 Mueller et al. ..... 335/153

4,403,203 9/1983 Schedele ..... 335/81

FOREIGN PATENT DOCUMENTS 58-49977 11/1983 Japan .

*Primary Examiner*—E. A. Goldberg

*Assistant Examiner*—Lincoln D. Donovan

*Attorney, Agent, or Firm*—Schwartz, Jeffery, Schwaab, Mack, Blumenthal & Evans

[57] ABSTRACT

The reed relay comprises a pair of fixed contact supports arranged at a regular spacing therebetween. A reed strip has a movable contact at a free end thereof and arranged so that the movable contact is positioned between the two fixed contact supports. A coil is wound around the reed strip, and a permanent magnet is disposed on one side of the movable contact. Since the permanent magnet is not positioned on the extension line of the reed strip, it is possible to readily inspect the contact conditions and the contact pressure without interruption due to the presence of the permanent magnet.

6 Claims, 3 Drawing Figures

REED RELAY

BACKGROUND OF THE INVENTION

1. Field of the Invention

The present invention relates generally to a reed relay used for automatically controlled various machines, equipment, systems, etc., and more specifically to a reed ralay of such a type that a permanent magnet is provided therein and the switching action can be made according to the direction that current is passed through an energizing coil in cooperation with the built-in permanent magnet.

2. Description of the Prior Art

An example of the prior-art reed relays of this type has been disclosed in Japanese Patent Publication No. 58-49977. In this reed relay, the permanent magnet is disposed on an assumed extension line of a reed strip having a movable contact at its free end. Since the reed strip is placed within a bobbin or a frame, the reed strip can be inspected only from the outside along the extension line of the reed strip. In the above prior-art reed relay, however, since the permanent magnet is disposed at the front of the movable reed contact (the free end) of the reed strip, this permanent magnet covers the movable reed contact, thus resulting in problems in that it is impossible to inspect or confirm the contact pressure and the contact conditions of the movable reed contact during or after reed relay assembling process. The above-mentioned drawbacks cause the dispersion in reed relay characteristics or the lack of stability in reed relay switching operation.

SUMMARY OF THE INVENTION

With these problems in mind, therefore, it is the primary object of the present invention to provide a reed relay such that it is possible to readily inspect or confirm the contact conditions and the contact pressure during or after assembling the reed relay elements in spite of a relatively simple relay construction.

To achieve the above-mentioned object, the reed relay according to the present invention comprises a pair of fixed contact supports each having a fixed contact and arranged at a regular spacing therebetween, a reed strip having a movable contact at a free end thereof and arranged so that the movable contact is positioned between a pair of the fixed contact supports, a coil wound around the reed strip, and a permanent magnet disposed on one side of the movable contact.

In the reed relay according to the present invention, since the permanent magnet is disposed on one side of the movable contact of the reed strip, the front space of the reed strip, that is, the space along the extension line of the movable contact formed at the free end of the reed strip is perfectly open towards the outside. Accordingly, even when or after the reed strip is inserted into a bobbin or a frame and therefore the reed strip is surrounded by the bobbin, the worker can easily inspect or confirm the contact conditions and the contact pressure of the movable contact of the reed against the fixed contact. Consequently, the worker can readily adjust the contact conditions and the contact pressure in order to manufacture reed relays of uniform quality and stable switching operation. Additionally, there exists another advantage such that is it possible to reduce the overall length of the reed relay by a dimension corresponding to permanent magnet in the longitudinal direction of the reed relay, thus realizing a more compact reed relay.

BRIEF DESCRIPTION OF THE DRAWINGS

The features and advantages of the reed relay according to the present invention will be more clearly appreciated from the following description taken in conjunction with the accompanying drawings in which.

DETAILED DESCRIPTION OF THE PREFERRED EMBODIMENT

Figure 1:
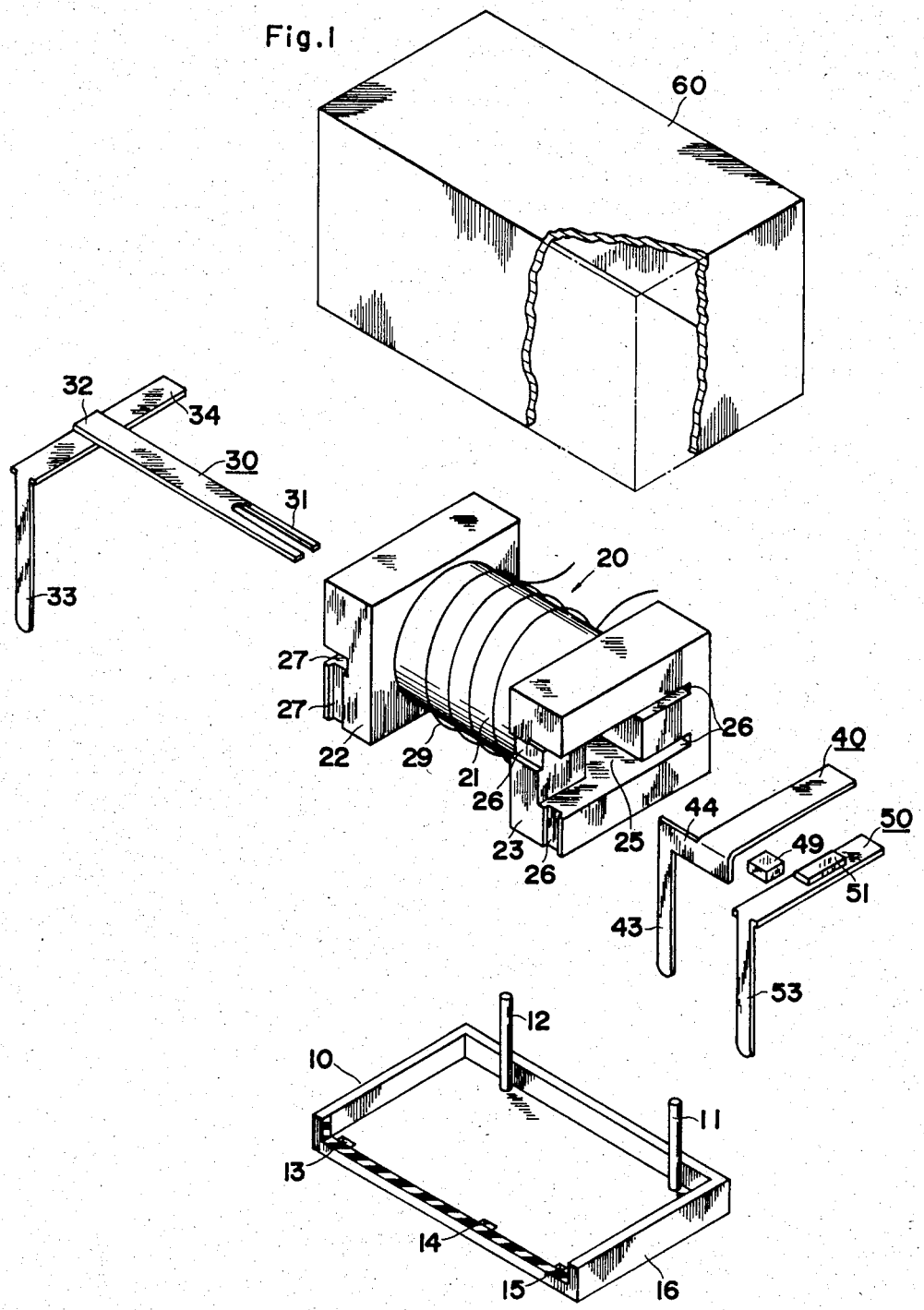
FIG. 1 is a perspective exploded view showing all the elements constructing the reed relay according to the present invention.
Figure 2:
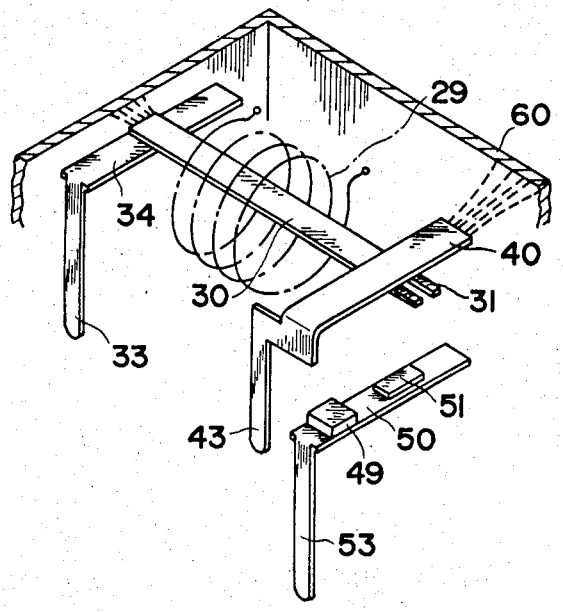
FIG. 2 is a perspective view showing the positional relationship between a reed strip, pair of fixed contact supports, and permanent magnet.
Figure 3:
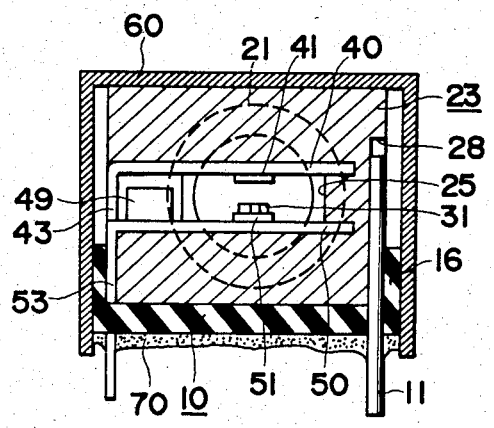
FIG. 3 is a lateral cross-sectional view of the aasembled reed relay.

With reference to FIGS. 1 to 3, the reed relay according to the present invention is composed of a base 10, a switching mechanism including a reed strip 30 and a pair of fixed contact supports 40 and 50, a support member 20 for the switching mechanism, and a causing 60.

The base 10 is made of an approprite insulating material such as resin and formed with a rising wall 16 for supporting the support member 20 along the outer periphery of the base 10. Near both the ends of one side of the base 10, two coil terminal pins 11 and 12 are vertically disposed passing through the base 10 and extending toward the inside and the outside of the relay. Further, on the other opposite side of the base 10, there are formed three vertical holes 13, 14 and 15 through which three connector pins (discribed later) are passed.

The reed strip 30 made of an elastic magnetic material has a movable reed contact 31 at the free end thereof. The surface of the movable reed contact is treated or plated by a contact material such as platinum rhodium. The base end 32 of the reed strip 30 is fixed by welding, for instance, to roughly the middle portion of a reed support 34 perpendicular thereto. At one end of the reed support 34, a common connector pin 33 is formed integrally with and perpendicularly to the reed support 34.

The two fixed contact supports 40 and 50 are also made of a magnetic material. At one end of the fixed contact support 40, a connector pin 43 is formed via a horizontally extending connecting member 44 integrally with and perpendicularly to the fixed contact support 40. Similarly, at one end of the fixed contact support 50, another connector pin 53 is directly formed integrally with and perpendicularly to the fixed contact support 50. At roughly the middle on the mutually opposing surfaces of these two fixed contact supports 40 and 50, a make-side contact 41 and a break-side contact 51 are mounted, respectively, so as to face to each other.

The support member 20 includes a hollow bobbin 21 around the outer circumference of which a coil 29 is wound, and two flanges 22 and 23 formed at both the ends of the bobbin 21 integrally therewith. The flange 23 is formed with an opening 25 at the middle thereof. At the upper and lower positions in the opening 25 and on the side surface of the flange 23, there are formed grooves or recesses 26 for receiving the two fixed contact supports 40 and 50, respectively. Similarly, the flange 22 is formed with an opening (not shown) at the middle thereof. In the opening of the flange 22, there are formed similar grooves or recesses 27 for receiving the reed support 34 for supporting the reed strip 30 and the common connector pin 33. Further, on the other side surface of each flange 22 or 23, there is formed a vertical groove 28 (shown in FIG. 3) into which the coil terminal pin 11 or 12 is engageably inserted, respectively.

The support member 20 is placed on the base 10. The reed strip 30 is passed through the hollow portion of the bobbin 21 and is held therewithin at such a position that the movable contact 31 of the reed strip 30 is positioned at the center of the opening 25 and also between two fixed contact supports 40 and 50 located at the upper and lower positions in the opening 25 in the flange 23.

A permanent magnet 49 is fixed on the upper surface of the fixed contact support 50 near one end and at one side thereof at such a position as to correspond to one side of the movable reed contact 31. The width and the thickness, where necessary, of the fixed contact support 40 are formed greater than those of the fixed contact support 50. The connector pins 33, 43 and 53 are all inserted into the three holes 13, 14 and 15, respectively, formed vertically in one side of the base 10 in such a way as to project toward the outside from the base 10. Both the ends of the coil 29 are connected by soldering, for instance, to the top end of the coil terminal pins 11 and 12, separately.

The casing 60 is made of a magnetic material, the inside surface of which is coated by an insulating material. This casing 60 is assembled with the base 10 so as to cover the support member 20, the reed strip 30, the fixed contact supports 40 and 50, etc. all assembled on the base 10.

Under the normal conditions, the movable contact 31 of the reed strip 30 is attracted toward the break-side contact 51 mounted on the fixed contact support 50 into contact therewith by a magnetic force generated by the permanent magnet 49. When current is passed through the coil 29 in a predetermined direction, however, the reed strip 30 is excited, so that the movable reed contact 31 is urged toward the make-side contact 41 mounted on the fixed contact support 40 into contact therewith away from the break-side contact 51 by a repulsive force generated between the movable reed contact 31 and the fixed break-side contact 51 and additionally by an attractive force generated between the movable reed contact 31 and the fixed make-side contact 41. The above-mentioned switching operation of the reed strip 30, of course, allows the electrical connection to be changed-over from the connection between the connectior pins 33 and 53 to the connection between the connector pins 33 and 43 or vice versa. Further, a coil current is supplied to the coil 29 for energization through the two coil terminal pins 11 and 12.

As described above, only when current is passed through the coil 29 in a predetermined direction, the reed strip 30 is brought into contact with the make-side contact 41, thus the operation of the reed relay being achieved. Further, since the fixed contact support 40 having the make-side contact 41 is formed greater in size or dimensions than the fixed contact support 50 having the break-side contact 51, the magnetic flux generated when the coil 29 is energized can easily flow through the magnetic path, as depicted by the dashed-lines in FIG. 2, thus resulting in a higher sensitivity in the relay switching operation.

By the way, the position of the movable contact 31 of the reed strip 30, the contacting conditions and the contact pressure between the movable contact 31 and the fixed make-side and break-side contacts 41 and 51 should be inspected or checked during the assembling process of the reed relay. In more detail, the above inspection should be made after the following steps: the reed strip 30 is inserted into the bobbin 21 of the support member 20; the reed support 34 for the reed strip 30 is engaged with the groove 27 of the flange 22; on the other hand, the two fixed contact supports 40 and 50 are engaged with the grooves 26 of the flange 23; the support member 20 is placed on the base 10; each connector pin 33, 43 or 53 is inserted into each hole 13, 14 and 15 formed in the base 10, separately; and further the coil terminal pins 11 and 12 are engaged with the grooves 28. That is, the above inspection should be made before putting the casing 60 on the assembled reed relay mounted on the base 10.

To inspect the contact pressure, for instance, a sensor of a tension meter is inserted under the reed strip 30, especially under the movable contact 31 through the opening 25 in the flange 23 of the support member 20, and a force required to release the contacting condition in which the movable reed contact 31 is in contact with the fixed break-side contact 51 is measured by pushing the reed strip 30 in the upward direction with the tension meter sensor. In the above-mentioned inspection process, since the permanent magnet 49 is positioned not on the extension line of the reed strip 30 but on the side of the movable contact 31 of the reed strip 30, it is possible to achieve the above-mentioned inspection operation easily and accurately. In case the position and the conditions of the reed strip 30 is found to be unacceptable, the reed strip 30 is adjusted by twisting or bending the portion of the reed support 34 at which the base end 32 of the reed strip 30 is fixed thereto by welding, for instance.

Upon completion of the adjustment as described above, both the ends of the coils 29 are soldered to the coil terminal pins 11 and 12, separately; the casing 60 is put on the base 10 for covering the relay assembly; a sealing material 70 is filled up on the outer surface of the base 10, as shown in FIG. 3, in order to fix the casing 60 and the respective connector pins 33, 43 and 53 to the base 10.

What is claimed is:

1. A reed relay comprising:

(a) a pair of fixed contact supports mounted at a first end of said relay each having a fixed contact thereon and arranged at a regular spacing therebetween;

(b) a reed strip having a fixed end mounted at a second end of said relay being opposed to said first end and a movable contact at a free end thereof and arranged so that said movable contact is positioned between said pair of fixed contacts, said movable contact also having a pair of sides;

(c) a coil wound around said reed strip; and (d) a permanent magnet disposed in contact with one of said fixed contact supports and on one of said sides of the movable contact of said reed strip and being spaced apart therefrom to allow an unobstructed viewing space to remain at the first end of the relay, allowing viewing of the free end of said reed strip.

2. The reed relay as set forth in claim 1, wherein one of said fixed contact supports is provided with a make-side fixed contact and the other thereof is provided with a break-side fixed contact, said fixed contact support provided with said make-side fixed contact is greater in size than that provided with said break-side fixed contact.

3. The reed relay as set forth in claim 2, wherein said permanent magnet is fixed to said fixed contact support provided with said break-side fixed contact.

4. A reed relay comprising:

(a) a support member including a hollow bobbin and first and second flanges formed at both ends of said hollow bobbin, each of said flanges being formed with an opening at a middle thereof;

(b) a pair of fixed contact supports fixed at upper and lower positions of the opening formed in the first flange of said support member;

(c) a reed strip having a fixed end fixed to the second flange of said support member and a free end extending through the hollow bobbin to the opening formed in the first flange, at a front portion of the relay the free end being positioned between a pair of said fixed contact supports so as to serve as a movable reed contact, said movable reed contact having a pair of sides;

(d) a coil wound around an outer circumference of the hollow bobbin of said support member;

(e) a permanent magnet disposed in contact with one of said fixed contact supports and on one of said sides of the movable reed contact and being spaced apart therefrom to allow an unobstructed viewing space to remain in the front portion, allowing viewing of the free end of said reed strip;

(f) a base for receiving said support member; and (g) a casing for covering said base and said support member.

5. The reed relay as set forth in claim 4, wherein said permanent magnet is fixed to one of said fixed contact supports.

6. The reed relay as set forth in claim 4, wherein said casing is made of a magnetic material.

* * * * *